US006097343A

United States Patent [19]

Goetz et al.

[11] Patent Number: 6,097,343

[45] Date of Patent: Aug. 1, 2000

[54] CONFORMAL LOAD-BEARING ANTENNA SYSTEM THAT EXCITES AIRCRAFT STRUCTURE

[75] Inventors: Allan C. Goetz, La Jolla; Haigan K. Chea, Oceanside, both of Calif.

[73] Assignee: TRW Inc., Redondo Beach, Calif.

[21] Appl. No.: 09/178,356

[22] Filed: Oct. 23, 1998

[51] Int. Cl.[7] ..... H01Q 1/28

[52] U.S. Cl. ..... 343/708; 343/767

[58] Field of Search ..... 343/708, 705, 343/767; H01Q 1/28

[56] References Cited

U.S. PATENT DOCUMENTS 2,518,843 8/1950 Wehner ..... 343/708

2,701,307 2/1955 Cary ..... 343/708

*Primary Examiner*—Michael C. Wimer

*Attorney, Agent, or Firm*—Michael S. Yatsko

[57] ABSTRACT

An antenna system structurally integrated into a load-bearing structural member of an aircraft, such as a wing (30), horizontal tail section (36), or vertical tail fin (20) in such a way as to cause practically no added aerodynamic drag and to add minimal weight to the aircraft. The antenna system includes a flared notch (22, 32, 34 or 38) of non-conductive material and an antenna feed (12) that excites conductive portions of the structural member on opposite sides of the notch at a selected feed point (40). The conductive portions of the structural member and other conductive portions of the entire aircraft are excited by signals applied to the antenna feed. As a result, the antenna performance provides high gain omnidirectionally, and supports both vertically and horizontally polarized communication functions over a wide range of VHF and UHF bands.

6 Claims, 4 Drawing Sheets

CONFORMAL LOAD-BEARING ANTENNA SYSTEM THAT EXCITES AIRCRAFT STRUCTURE

BACKGROUND OF THE INVENTION

This invention relates generally to aircraft antenna systems and, more particularly, to aircraft antenna systems that conform to the surface of aircraft and electromagnetically excite a least adjacent portions of the aircraft structure. U.S. patent application Ser. No. 08/712,686, filed Sep. 12, 1996 and entitled "Multifunction Structurally Integrated VHF-UHF Aircraft Antenna System," now U.S. Pat. No. 5,825,332 discloses an aircraft antenna system structurally integrated into an aircraft tail fin. Basically, a notch antenna is incorporated into an endcap structure of the vertically oriented tail fin assembly and uses vertically polarized excitation.

Although the prior application referred to above provides good performance of very-high-frequency (VHF) and ultra-high-frequency (UHF) radio signals, there is still a need for an antenna system that produces both vertically polarized and horizontally polarized fields, and that can be integrated into larger load-bearing portions of an aircraft structure rather than a tail fin endcap.

U.S. Pat. No. 5,184,141 to Connolly et al. suggests integration of an antenna into a load-bearing member of an aircraft structure. However, the antenna in Connolly et al. is a dipole or other type of antenna installed behind a transparent window in the aircraft surface, and does not directly excite any portion of the aircraft structure.

Accordingly, there is still a need for a multifunction antenna for installation in manned or unmanned aircraft, with a single radiating element that supports many communication, navigation and identification (CNI) functions, and providing an omnidirectional pattern of both vertically polarized and horizontally polarized radiation. Moreover, the antenna should be of low cost, light weight, and be able to be integrated into larger load-bearing members of the aircraft structure. The present invention meets all these needs and has additional advantages over the prior art.

SUMMARY OF THE INVENTION

The present invention resides in an aircraft antenna structurally integrated into a load-bearing structural member of an aircraft. Briefly, and in general terms, the antenna comprises an antenna notch formed from non-conductive material and positioned between two adjacent conductive regions of an aircraft structural load-bearing member. The notch and the two adjacent conductive regions are structurally integrated to perform the intended mechanical functions of the load-bearing member, and the notch extends from a narrow region to a flared wider region. The antenna also includes an antenna feed terminating at a feed point located in the narrow region of the notch, to couple transmitted energy into the notch and to couple received energy out of the notch. In the antenna structure of the invention, the adjacent conductive regions and other conductive regions of the entire aircraft structure function as a radiating and receiving component of the antenna, which provides an omnidirectional radiation pattern supporting vertically and horizontally polarized communication functions.

In one disclosed embodiment of the invention, the load-bearing structural member into which the antenna is integrated is a vertical tail fin, and the antenna notch extends from a narrow region at a leading edge of the tail fin to a wider region located higher on the leading edge.

In another embodiment of the invention, the load-bearing structural member into which the antenna is integrated is a wing section, and the antenna notch extends from a narrow region at an edge of the wing section to a wider region located on the same edge. The edge may be the leading edge or the trailing edge of the wing.

In yet another embodiment of the invention, the load-bearing structural member into which the antenna is integrated is a horizontal tail section, and the antenna notch extends from a narrow region at a leading edge of the horizontal tail section to a wider region located on the same edge.

It will be appreciated from this summary that the present invention represents a significant advance in the field of aircraft antenna design. Specifically, the invention provides an efficient multifunction antenna with instantaneous bandwidths wide enough to cover VHF and UHF communications, navigation and identification (CNI) bands and having desirably high gain performance in all directions. Other aspects and advantages of the invention will become apparent from the following more detailed description, taken in conjunction with the accompanying drawings.

DESCRIPTION OF THE PREFERRED EMBODIMENTS

Figure 1:
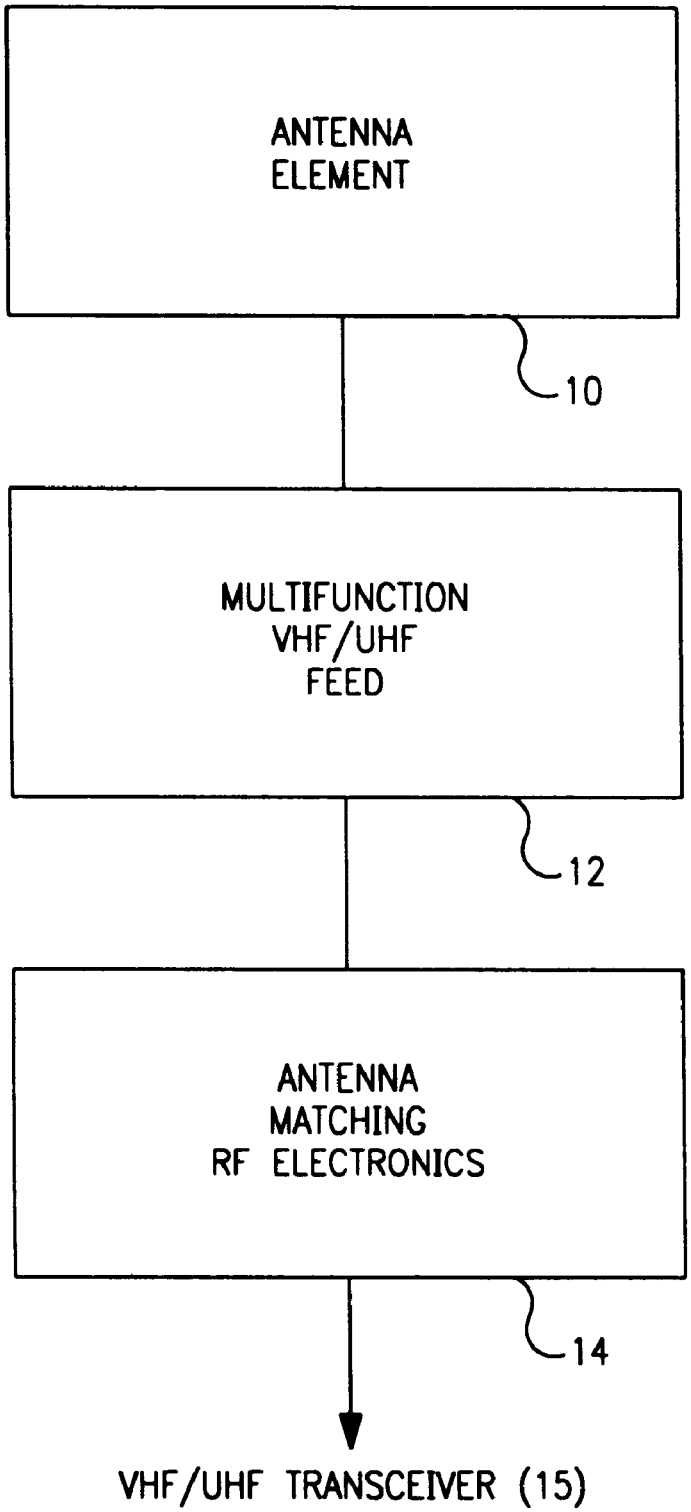
FIG. 1 is a block diagram showing the three principal components of the antenna system of the present invention.

As shown in the drawings for purposes of illustration, the present invention pertains to an aircraft antenna system that is integrated into load-bearing members of an aircraft and excites substantial portions of the aircraft structure at very-high frequencies (VHF) and ultra-high frequencies (UHF). Both commercial and military aircraft need efficient, multifunction antennas that have instantaneous bandwidths that are wide enough to cover the VHF and UHF communications, navigation and identification (CNI) bands. Ideally, these antennas should be conformal, low cost and light weight, to minimize their effect on aerodynamics of the aircraft and on its payload.

Prior to the present invention, commercial aircraft have used 13-inch (33 cm) blade antennas to support a commercial aircraft voice communications function. Other functions may require the use of a standard 9-inch (23 cm) blade antenna. Blade antennas increase aerodynamic drag by approximately one percent and, because they protrude from the aircraft, are prone to damage. Proposals for conformal antennas have been limited to antenna elements installed behind electromagnetically transparent windows in the aircraft skin, or to the addition of smaller conformal antennas on a vertical tail fin endcap.

In accordance with the present invention, a structurally integrated multifunction antenna element is integrated into a relatively large portion of a tail or wing section of an aircraft in order to provide an omnidirectional radiation pattern from a single antenna element, with wide instantaneous bandwidth. The element excites the conductive skin of the aircraft so that much of the aircraft skin functions as a radiating surface. Even though the excitation fields are horizontally polarized, vertically polarized radiation fields are produced due to the structural excitation. Thus, even when the antenna element is integrated into a wing section or a horizontal tail section, it will support vertically polarized VHF/UHF communications functions.

FIG. 1 shows the three principal components of the antenna system of the invention. These include an antenna element 10, a multifunction VHF/UHF antenna feed 12, and antenna matching RF (radio frequency) electronics 14 for coupling the antenna system to a VHF/UHF transceiver, indicated at 15.

Figure 2:
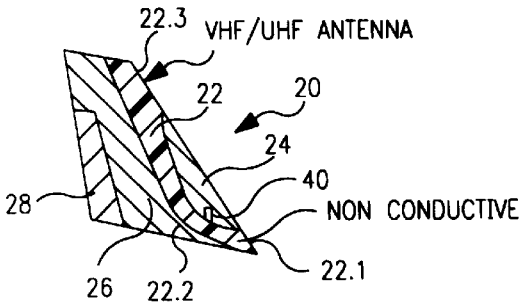
FIG. 2 is a fragmentary perspective view of a vertical tail section of an aircraft, depicting an installed antenna in accordance with the present invention.
Figure 3:
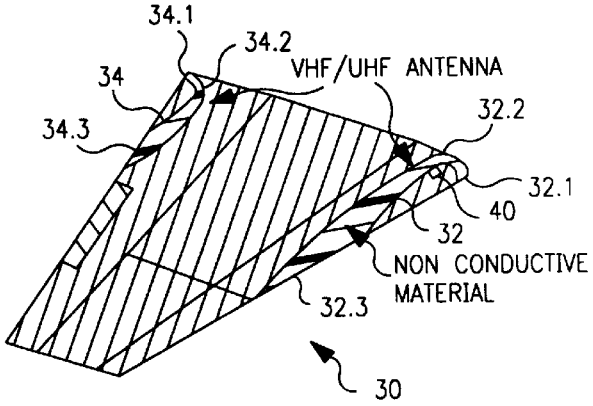
FIG. 3 is a view similar to FIG. 2 but showing an antenna installed in two possible locations on a wing of an aircraft.
Figure 4:
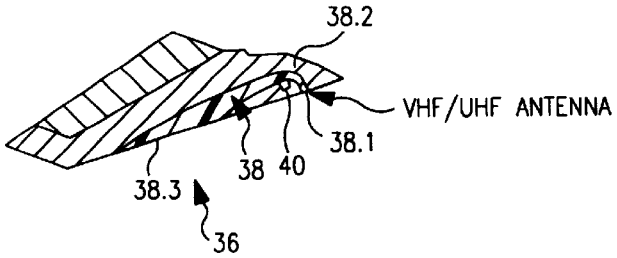
FIG. 4 is a view similar to FIG. 2 but showing an antenna installed in a horizontal tail section of an aircraft.

FIGS. 2, 3 and 4 depict multiple embodiments of the invention in which the common principle is the integration of a relatively large notch antenna into a load-bearing member of the aircraft structure. FIG. 2 shows a vertical tail fin 20 in which a notch antenna 22 is incorporated, not into an endcap but extending over the entire height of the fin and over much of its length. The fin 20 shown includes a leading edge portion 24 made from conventional conductive materials and a trailing edge portion 26 with a rudder assembly 28, also made from conventional conductive materials, and an intermediate portion 22 that defines the notch of the integrated antenna. The notch 22 begins as a relatively narrow portion 22.1 at the lower leading edge of the fin 20, extends in a rearward direction to a narrow throat area 22.2, and then extends generally upward, flaring to its widest portion 22.3, where the notch terminates at the upper leading edge and the forward upper edge of the fin 20.

The entire volume of the notch 22 is fabricated from materials that are electrically nonconductive but have sufficient mechanical strength to allow the load-bearing member of the aircraft in which the notch antenna is integrated, to perform its intended mechanical function. The antenna notch 22, therefore, has to be carefully designed and integrated with the conventional materials on each side of it, and may be fabricated from phenolic honeycomb structures, glass/epoxy resins or similar materials. Because these materials are not always as strong as metals, the design of the entire member, such as the tail fin 20, must be adjusted to compensate for the presence of the non-conductive materials in the notch. It will be understood that there may be some regions of an aircraft structural member that will be unsuitable for integration of an antenna. For example, if hydraulic lines traverse a region of a wing section and cannot be easily re-routed, integration of a notch antenna into this region would be impractical. It would be equally impractical to locate the antenna on or near movable control surfaces, such as ailerons, elevators, rudders or flaps.

FIG. 3 show a portion of an aircraft wing 30 with two notch antennas 32 and 34, located on the leading and trailing edges, respectively, of the wing. Antenna notch 32 extends from a narrow portion 32.1 at the leading edge of the wing, extends rearward for a short distance to a narrow throat region 32.2, and from there extends laterally in the direction of the wing tip, flaring to an increased width and terminating with its widest portion 32.3 at the leading edge again. The antenna notch 34 at the trailing edge of the wing 30 is similar in shape to the notch 32. The notch 34 extends from a narrow portion 34.1 at the trailing edge of the wing 30, extends forward for a short distance to a narrow throat region 34.2, and from there extends laterally in the direction of the wing tip, flaring to an increased width and terminating with its widest portion 34.3 at the trailing edge again.

By way of further example, FIG. 3 shows a horizontal tail section 36 with an integrated notch antenna 38 in its leading edge. Like the antenna 32 in the leading edge of the wing 30, this antenna notch 38 extends from a narrow portion 38.1 at the leading edge, extends rearward for a short distance to a narrow throat region 38.2, and from there extends laterally in the direction of the tip of the horizontal tail section, flaring to an increased width and terminating with its widest portion 38.3 at the leading edge again.

In conventional notch antennas, the notch is typically excited through the antenna feed 12, at a feed point located approximately one-quarter wavelength (N4) from the narrow end of the notch. This is obviously not possible in an aircraft tail fin when the wavelength may be as large as ten meters. In the embodiments illustrated, an antenna feed point, indicated at 40 in FIGS. 1–3, is located at an optimum distance along the notch 22, 32, 34 or 38. At the antenna feed point 40, connections are made from the antenna feed 12, which typically takes the form of a coaxial cable, to opposite sides of the antenna notch. The exact location of the antenna feed point 40 may be critical to good performance, and is best determined experimentally for a specific aircraft configuration and wavelength. Each notch antenna also needs matching electronics 14 (FIG. 1) to match the impedance of the notch to a standard value, such as 50 ohms.

Figure 5:
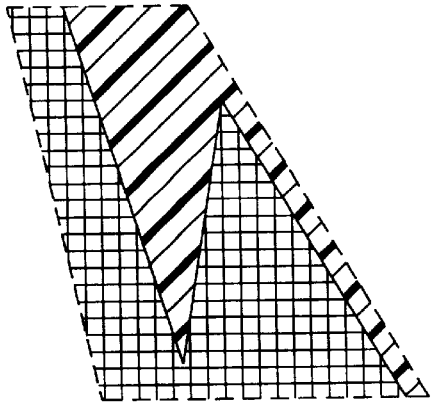
FIG. 5 is a diagrammatic view of a wire grid simulation model of the aircraft vertical tail section of FIG. 2.

FIG. 5 shows a wire grid simulation model of the tail fin 20 of FIG. 2. Using a well known numerical modeling technique referred to as the method of moments, the wire grid model provided computer-generated theoretical feed points, impedances and a radiation pattern for comparison with experimental measurements.

Another critical factor in the antenna design is the width of the notch 22, 32, 34 or 38. If this spacing is too small, the feed point admittance will be adversely affected by excessive capacitive susceptance. Although the method of moments simulation can be used to select the notch width, the presently preferred approach is to select the notch width experimentally using a full-scale test fixture of a specific aircraft.

Figure 6:
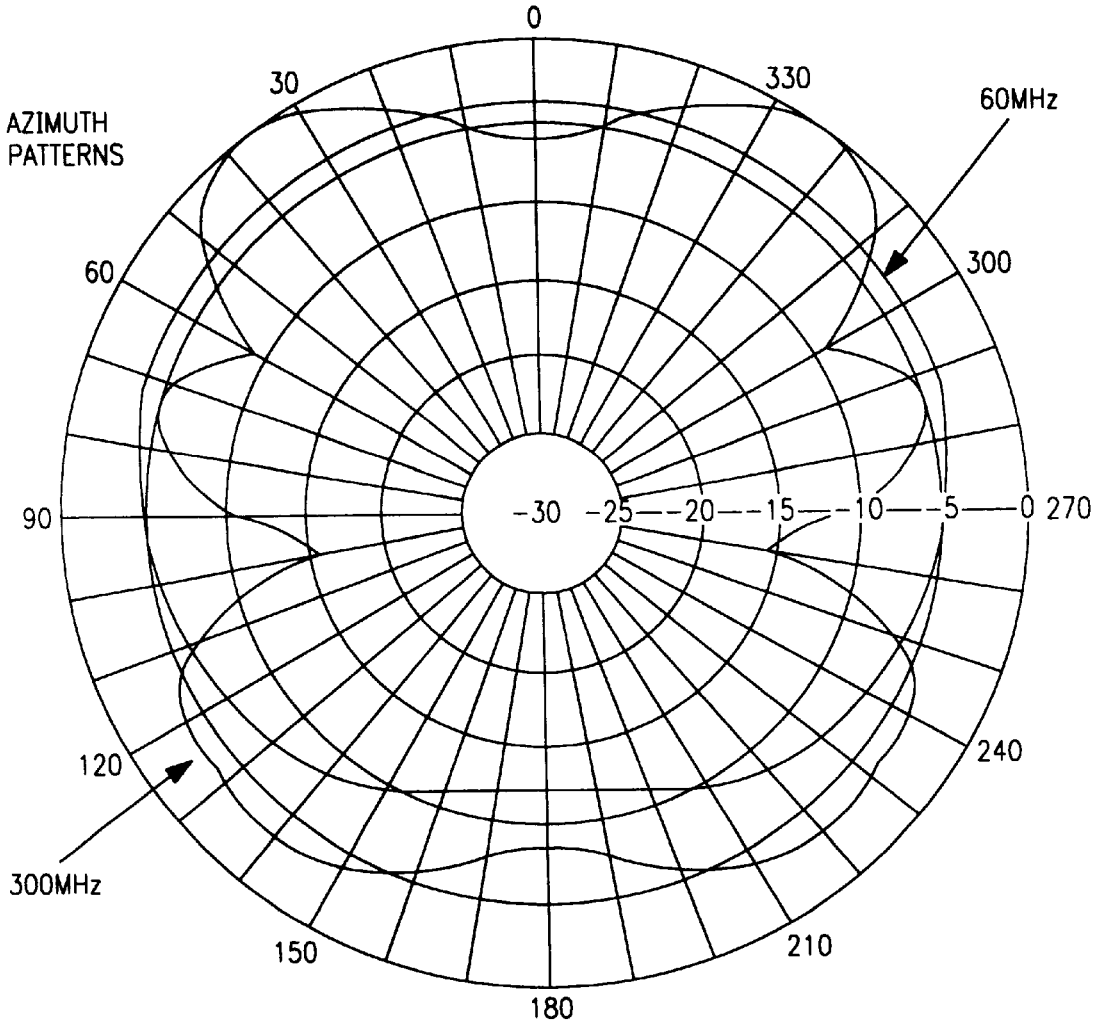
FIG. 6 is a predicted radiation pattern for the antenna of FIG. 2, plotting the variation of gain versus azimuth angle for frequencies of 60 MHz and 300 MHz, and for both vertical and horizontal polarization.
Figure 7:
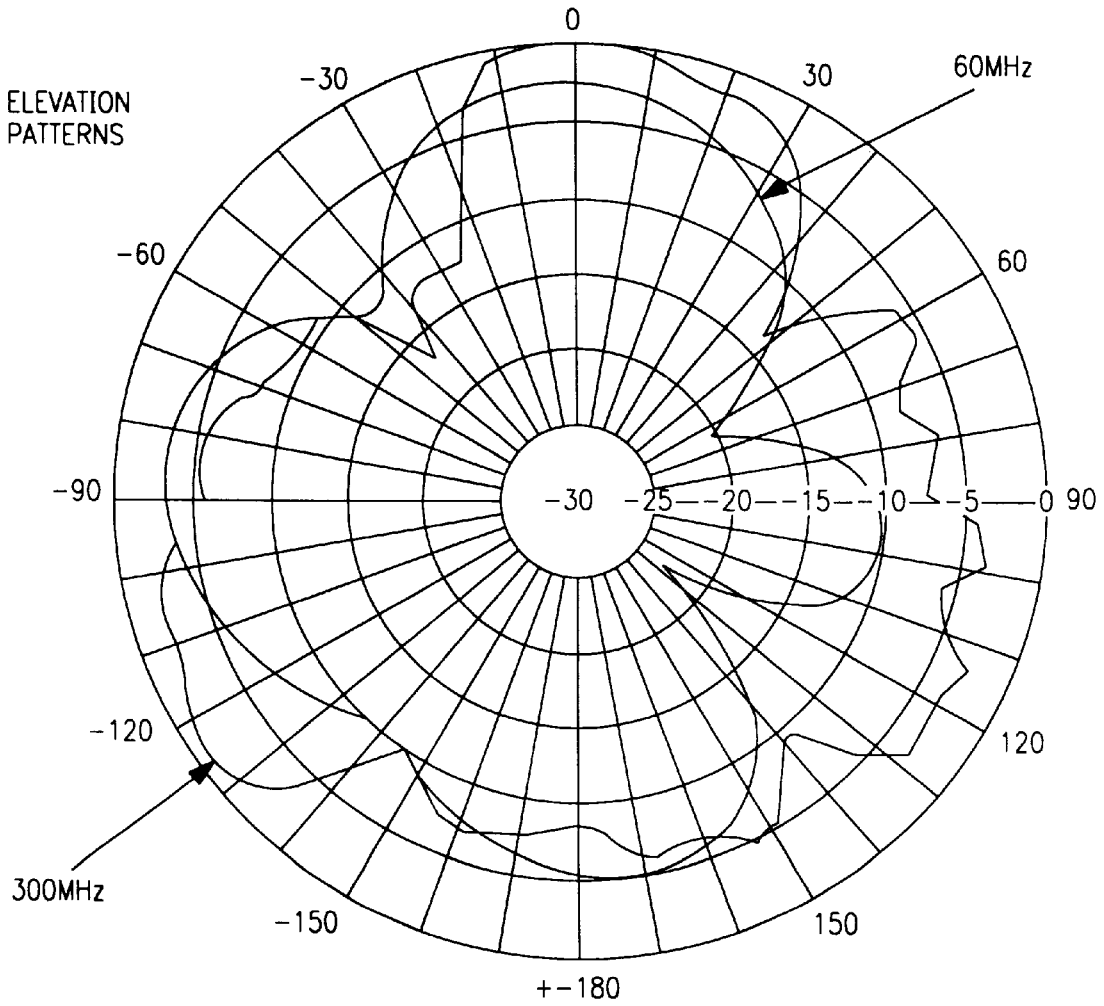
FIG. 7 is a predicted radiation pattern similar to FIG. 5, but showing the variation of gain versus elevation angle.

FIG. 6 shows the performance of the antenna in terms of gain, plotted in a radial direction, and azimuth angle from 0° to 360°. The two curves depicted are for performance at 60 megahertz (MHz) and 300 MHz, respectively, and indicate the gain for both vertical and horizontal polarization. FIG. 7 shows similar performance curves, but for variation in elevation angle between 0° and ±180°. FIGS. 6 and 7 show that the antenna performance is basically omnidirectional in three-dimensional space, for both vertical and horizontal polarization.

It will be appreciated from the foregoing that the present invention represents a significant advance in the field of antennas for aircraft and for other vehicles. The invention provides a highly efficient multifunction antenna with high gain in all directions and for both vertical and horizontal polarization. Moreover, the antenna of the invention does not significantly affect aerodynamic or payload performance of the vehicle. Although a number of embodiments of the invention have been described in detail for purposes of illustration, it will also be appreciated that various modifications may be made without departing from the spirit and scope of the invention. Accordingly, the invention should not be limited except as by the appended claims.

What is claimed is:

1. An aircraft antenna system structurally integrated into a load-bearing structural member of an aircraft, the antenna comprising:

an antenna notch formed from non-conductive material and positioned between two adjacent conductive regions of an aircraft structural load-bearing member, wherein the notch and the two adjacent conductive regions are structurally integrated to perform mechanical functions of the load-bearing member, and wherein the notch extends from a narrow region to a flared wider region; and an antenna feed terminating at a feed point located in the narrow region of the notch, to couple transmitted energy into the notch and to couple received energy out of the notch;

and wherein the adjacent conductive regions and other conductive regions of the entire aircraft structure function as a radiating and receiving component of the antenna system, which provides an omnidirectional radiation pattern supporting vertically and horizontally polarized communication functions.

2. An aircraft antenna system as defined in claim 1, wherein:

the load-bearing structural member into which the antenna is integrated is a vertical tail fin, and the antenna notch extends from a narrow region at a leading edge of the tail fin to a wider region located higher on the leading edge.

3. An aircraft antenna system structurally integrated into a load-bearing structural member of an aircraft, the antenna comprising:

an antenna notch formed from non-conductive material and positioned between two adjacent conductive regions of an aircraft structural load-bearing member, wherein the notch and the two adjacent conductive regions are structurally integrated to perform mechanical functions of the load-bearing member, and wherein the notch extends from a narrow region to a flared wider region; and an antenna feed terminating at a feed point located in the narrow region of the notch, to couple transmitted energy into the notch and to couple received energy out of the notch;

and wherein the adjacent conductive regions and other conductive regions of the entire aircraft structure function as a radiating and receiving component of the antenna system, which provides an omnidirectional radiation pattern supporting vertically and horizontally polarized communication functions;

and wherein the load-bearing structural member into which the antenna is integrated is a wing section, and the antenna notch extends from a narrow region at an edge of the wing section to a wider region located on the same edge.

4. An aircraft antenna system as defined in claim 3, wherein:

the antenna is located near the leading edge of the wing section.

5. An aircraft antenna system as defined in claim 3, wherein:

the antenna is located near the trailing edge of the wing section.

6. An aircraft antenna system structurally integrated into a load-bearing structural member of an aircraft, the antenna comprising:

an antenna notch formed from non-conductive material and positioned between two adjacent conductive regions of an aircraft structural load-bearing member, wherein the notch and the two adjacent conductive regions are structurally integrated to perform mechanical functions of the load-bearing member, and wherein the notch extends from a narrow region to a flared wider region; and an antenna feed terminating at a feed point located in the narrow region of the notch, to couple transmitted energy into the notch and to couple received energy out of the notch;

and wherein the adjacent conductive regions and other conductive regions of the entire aircraft structure function as a radiating and receiving component of the antenna system, which provides an omnidirectional radiation pattern supporting vertically and horizontally polarized communication functions;

and wherein the load-bearing structural member into which the antenna is integrated is a horizontal tail section, and the antenna notch extends from a narrow region at a leading edge of the horizontal tail section to a wider region located on the same edge.

* * * * *